US006659293B1

(12) United States Patent
Smith

(10) Patent No.: US 6,659,293 B1
(45) Date of Patent: Dec. 9, 2003

(54) PULL-OUT SHELF STOCKING SYSTEM

(75) Inventor: Ronald E. Smith, Sante Fe, NM (US)

(73) Assignee: Odwalla, Inc., Half Moon Bay, CA (US)

( * ) Notice: Subject to any disclaimer, the term of this patent is extended or adjusted under 35 U.S.C. 154(b) by 0 days.

(21) Appl. No.: 09/346,785

(22) Filed: Jul. 7, 1999

(51) Int. Cl.[7] ..... A47F 1/04; A47F 5/00

(52) U.S. Cl. ..... 211/59.2; 312/334.32; 248/244; 211/74; 211/126.15; 211/90.02; 211/175

(58) Field of Search ..... 211/59.2, 74–75, 211/151, 162, 90.02, 126.15, 187, 150, 175; 312/273–276, 332, 334.31, 334.32, 334.27, 350; 108/5, 6, 140, 143, 179; 248/242, 244, 298.1, 419–420, 292.14

(56) References Cited

U.S. PATENT DOCUMENTS

| | | | | | |
|---|---|---|---|---|---|
| 735,716 | A | * | 8/1903 | Dahlquist | 248/298.1 |
| 1,398,611 | A | * | 11/1921 | Van Alstyn | 248/298.1 |
| 1,607,847 | A | * | 11/1926 | Reitzel | 248/298.1 |
| 2,013,284 | A | * | 9/1935 | Michaud | 248/298.1 |
| 2,698,214 | A | * | 12/1954 | Skamser | 248/298.1 |
| 3,643,808 | A | * | 2/1972 | Ryan et al. | 211/134 |
| 3,975,071 | A | * | 8/1976 | Quinn | 312/334.31 |
| 4,019,638 | A | * | 4/1977 | Miller | 211/75 |
| 4,397,606 | A | | 8/1983 | Bruton | |
| 4,407,418 | A | * | 10/1983 | Brammer | 248/298.1 |
| 4,485,937 | A | | 12/1984 | Adams | |
| 4,589,349 | A | * | 5/1986 | Gebhardt et al. | 211/150 |
| 4,592,530 | A | * | 6/1986 | Seely et al. | 248/298.1 |
| 4,620,489 | A | * | 11/1986 | Albano | 211/151 |
| 4,627,542 | A | | 12/1986 | Fredrickson | |
| 4,653,818 | A | * | 3/1987 | DeBruyn | 312/246 |
| 4,771,898 | A | * | 9/1988 | Howard et al. | 211/59.2 |
| 4,809,855 | A | * | 3/1989 | Bustos | 211/59.2 |
| 4,923,070 | A | * | 5/1990 | Jackle et al. | 211/59.2 |
| 4,995,509 | A | * | 2/1991 | Kornfeind | 211/75 |
| 5,197,610 | A | * | 3/1993 | Bustos | |
| 5,230,554 | A | * | 7/1993 | Camilleri | 312/334.31 |
| 5,330,063 | A | * | 7/1994 | Remmers | 211/162 |
| 5,363,774 | A | * | 11/1994 | Anada et al. | 108/143 |
| 5,439,122 | A | * | 8/1995 | Ramsay | 211/187 |
| 5,474,374 | A | | 12/1995 | Sandvig | |
| 5,511,646 | A | | 4/1996 | Maldanis et al. | |
| 5,531,159 | A | | 7/1996 | Stubblefield | |
| 5,638,985 | A | | 6/1997 | Fitzgerald et al. | |
| 5,738,019 | A | | 4/1998 | Parker | |
| 5,749,478 | A | * | 5/1998 | Ellis | 211/59.2 |
| 5,944,201 | A | * | 8/1999 | Babboni et al. | 211/151 |
| 5,970,887 | A | * | 10/1999 | Hardy | 211/153 |

FOREIGN PATENT DOCUMENTS

| | | |
|---|---|---|
| DE | 2816999 | * 10/1979 |
| EP | 553362 | 8/1993 |
| EP | 696547 | 2/1996 |
| EP | 734975 | 10/1996 |
| EP | 0875187 | * 11/1998 |

* cited by examiner

*Primary Examiner*—Blair M. Johnson
*Assistant Examiner*—Jennifer E. Novosad
(74) *Attorney, Agent, or Firm*—Morrison & Foerster LLP

(57) ABSTRACT

A sliding pull-out tray assembly comprising trays which can be tilted and extended with respect to a supporting shelf structure and which are used for holding and delivering containers, using gravity feed, to the front of the trays. The tray assembly comprises an open-top tray having surrounding walls on the front and sides, and which is mounted on a linear sliding system allowing sliding movement relative to the wire rack shelf to which the tray assembly is attached. By raising the front or lowest end of the tray, the tray assembly may be slid forward so that the rear of the tray may be filled without necessarily disturbing any bottles or cans already present in the front of the tray. The position of the tray apparatus is maintained by fastening the tray apparatus to the back of the supporting wire rack shelf. The pull-out tray assembly may be used as a retrofit in existing refrigerators or refrigeration units by serving as original or replacement shelves.

12 Claims, 6 Drawing Sheets

500
502
504
506
508
510
512
514
515
516

PULL-OUT SHELF STOCKING SYSTEM

FIELD OF THE INVENTION

This invention relates to a sliding tray assembly which may be used, for instance, in delivering drink bottles or cans using gravity, to the front of the tray. In particular, the invention deals with one or more trays having a surrounding wall which remains in place during normal use, but by slightly raising the front or lowest end of the tray, may be slid forward so that the rear of the tray may be filled without necessarily disturbing the bottles or cans present in the tray's front. This device is especially useful as an adapter to be used on the shelves of pre-existing refrigeration units. It may also be a shelf itself for original or replacement shelves inside a refrigeration unit.

BACKGROUND OF THE INVENTION

It is now common that fruit juices, soft drinks, and other blended and mixed beverages are sold in small containers containing 8 to 30 ounces of liquid. They are commonly sold as single purchases and are sold from a refrigeration unit. The refrigerator style units are very unlike the old chest units where drinks were simply dumped into an open refrigerated chest. These modern tall refrigeration units often use interior shelves and the newer styles use trays which rack the beverages in a single line allowing the containers to slide towards the front of the shelf under the influence of gravity. Said another way: if the front drink bottle is removed, the remaining drink bottles slide by themselves towards the front of the tray or shelf. This movement provides another drink or beverage conveniently at the front of the tray.

Reloading these beverage trays is not always straightforward. Often, in refrigeration units which face outward from large open refrigerated rooms, the drinks are simply added from the back of the tray. However, if the back of the refrigeration unit is solid, that is to say, without a door, it is often necessary to push the front drinks back up the tray to load the newer drinks onto the front. This, in itself, makes rotation of stock difficult. Removal of the older drinks is therefore necessary if the older drinks are to be sold first.

This invention simplifies the addition of fresh beverage stock to the rear of the shelves.

Typical vending machines used for dispensing food or drink containers are those shown in U.S. Pat. No. 4,485,937, to Adams. The Adams device is a can dispensing apparatus in which the cans, unlike the typical use of the inventive device described therein, uses a chute having cans on their side which tend to roll through a convoluted path to a dispensing site at the front of the chute. These chutes are loaded from the top.

Another fairly typical vending machine is shown in U.S. Pat. No. 5,511,646, to Maldanis et al. The device shown there uses a number of movable shelves which, for display purposes, move up and down on a carousel. When the selected shelf is in the appropriate position, the food or drink is selected using electronic means.

Although no apparatus similar to that apparatus described herein is known, other pull-out shelves are known. For instance, U.S. Pat. No. 5,474,374 to Sandvig, describes a sliding tray assembly fitting into a kitchen cabinet. The device described in Sandvig supports a tray panel and guide channels located at the edge of the panel. The edges are affixedly attached to the furniture into which it is placed.

U.S. Pat. No. 4,397,606 describes an article handling apparatus having a number of trays arranged side by side.

The trays are slideable from a larger shelf. Further, there is a shelf caddy onto which the trays may be slid when being refilled or the like.

Drop down or tilting shelf display assemblies are shown in U.S. Pat. No. 4,627,542, to Frederickson. The Frederickson patent describes only a shelf assembly which allows gravity feed of various types of merchandise (see FIG. 2) but does not deal with the inventive concept employed in our invention, that of sliding the shelves outwardly from a cabinet for loading canned or bottled merchandise onto the back of the shelves.

U.S. Pat. No. 5,531,159, to Stubblefield, shows a pull-out drop-down shelf structure which is significantly more complicated than the inventive device and utilizes specific shelf backing which supports a complete shelf at the edge.

Finally, U.S. Pat. No. 5,738,019, to Parker shows adjustable shelf assembly which is designed in such a way that the shelf, itself, rotates from supports at the rear of the shelf. FIG. 3A there shows a runner assembly mounting means which allows a complete shelf to be pulled out.

None of the documents discussed above discloses a device which is similar to the pull-out trays described and claimed herein.

SUMMARY OF THE INVENTION

As noted above, the invention is a pull-out tray assembly for holding and delivering containers, usually drink containers, using gravity feed. The containers themselves typically are placed in a line in the tray and are set on their bottoms rather than on their sides. Central to this invention is the concept that the front of a tray, or a group of trays, may be slightly lifted and the tray or trays slid forward and down for ease of introducing additional containers to the back of the tray.

DESCRIPTION OF THE INVENTION

As noted above, the invention is a pull-out tray assembly for holding and delivering containers, usually drink containers, using gravity feed. The containers themselves typically are placed in a line and are set on their bottoms rather than on their sides. Central to this invention is the concept that the front of a tray, or a group of trays, may be slightly lifted and the entire tray or tray assembly slid forward and, often, down for ease of introducing additional containers to the back of the tray.

Figure 1:
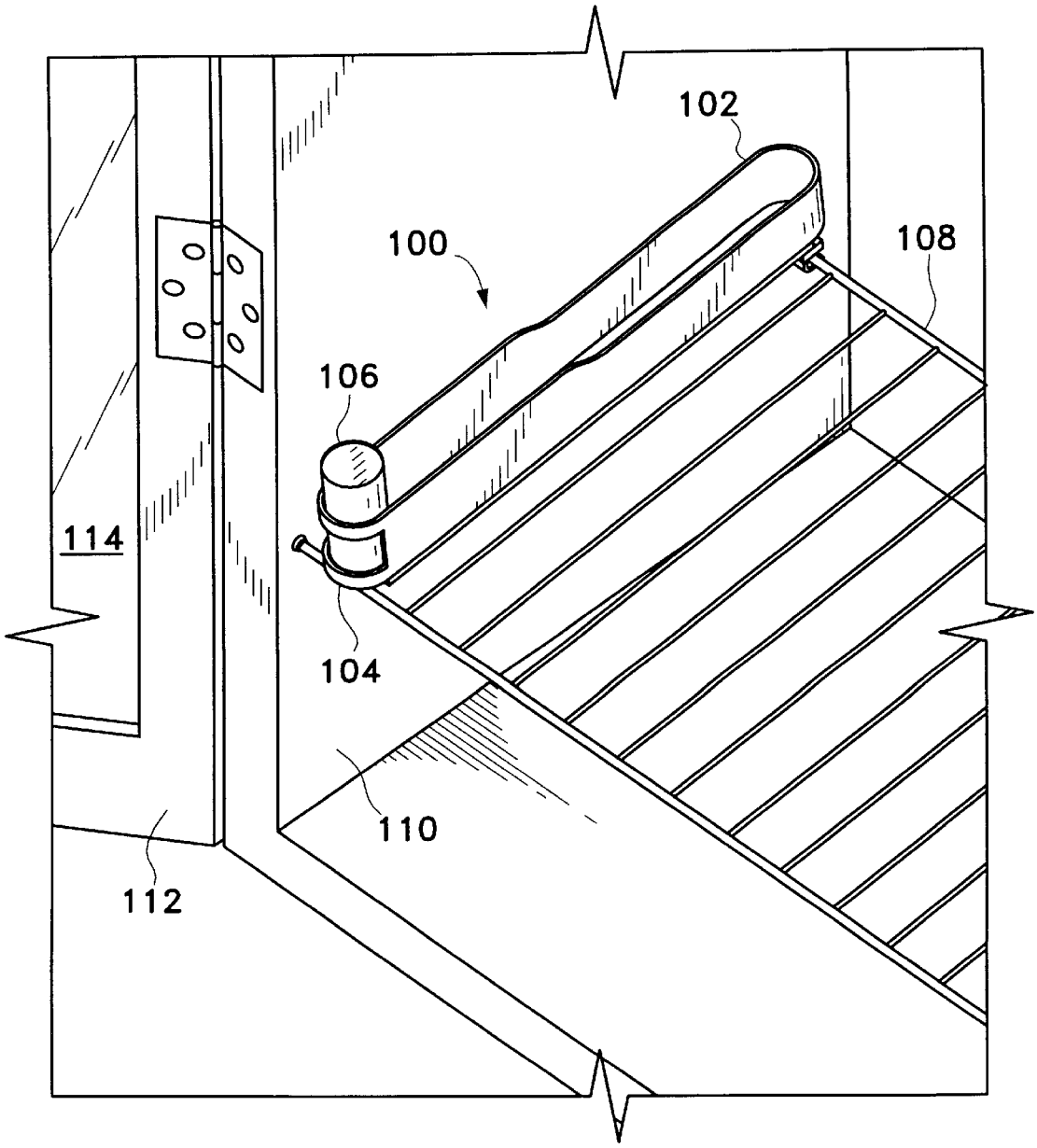
FIG. 1 shows in perspective the placement of a pull-out tray assembly made according to the invention as it might be placed in a refrigerator.

FIG. 1 is a partial front view of an inventive tray assembly (100) as it might be mounted in a typical refrigerator box. The FIG. 1 depiction includes only a single open top tray (102), but as will be discussed below, the trays themselves may be used in multiples. At the front lower edge of tray assembly (100) may be seen the front edge of the linear slide assembly (104). It should be clear that the tray assembly (100) is tilted so that a container (106) will slide towards the front or lower end of tray (102). In the variation shown in FIG. 1, the shelf (108) upon which the inventive device is placed is tilted at an angle. In this instance, the shelf assembly is essentially an add-on to a shelf which shelf may be set at an angle due to the design of the shelf and its refrigerator. The tray assembly (100) would then be considered an adapter. The remainder of the refrigerator box comprising back wall, floor, sidewall and the like (110) and the front door of (112) with its window (114) may also be seen in FIG. 1.

A FIG. 1 is used simply for the conceptualization of placement of the inventive tray assembly (100) in a refrigerator. It will be apparent later that it is not necessary that the shelf (108) itself be tilted; it is just as appropriate that the rear end of tray assembly (100) have a spacer beneath it so to allow gravity feed of containers (106). Similarly, the tray assembly need not be an add-on or a converter for pre-existing shelves (108) or the like, but may be made as a portion of or molded onto shelves per se.

Figure 2A:
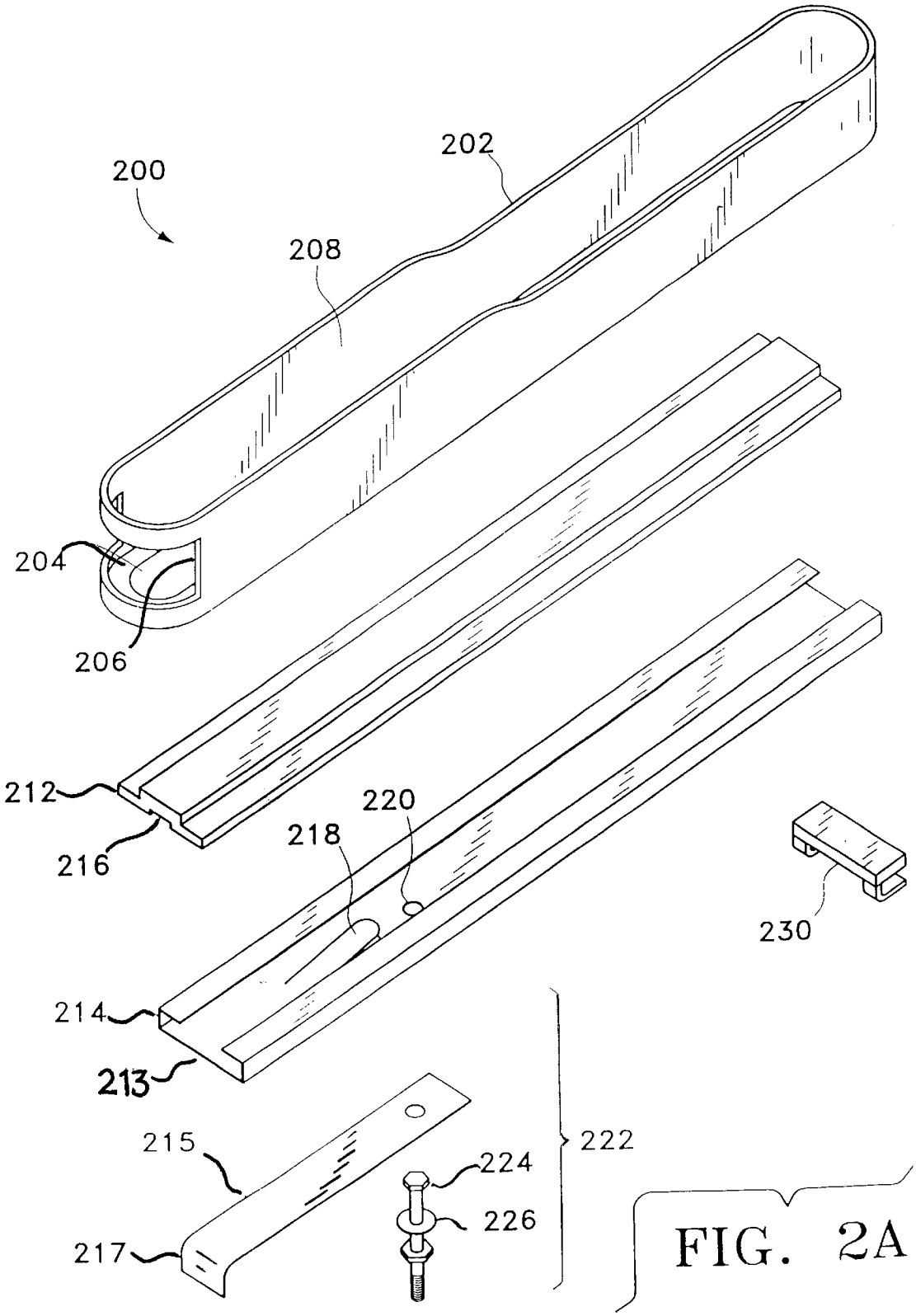
FIG. 2A is an exploded diagram of one variation of the invention.

FIG. 2A shows a variation of the inventive tray assembly (200). This variation includes an open top tray (202) having a closed floor (204) and open area (206) at the front or bottom end of open top tray (202). The tray (202) has high sides (208) to hold the containers in place. Trays of this type are fairly well-known and may be made out of a variety of materials, such as polycarbonates, polypropylene, and other known and suitable materials for this service. Desirably, they are clear to allow visibility of the product and provide better visual information on when cleaning may be necessary.

Also shown in FIG. 2A are linear slide components (212) and (213). In this variation of the invention, the upper linear slide component (212) is an extrusion or otherwise shaped slide section which is generally a flattened "T" section desirably having slot (216) which is of a variable depth so to engage the rolled edge component (214). Slot (216) should prevent the combination of the tray (202) and the T-shaped section (212) of the linear slide assembly from disengagement when pulled out as shown below. The T-shaped inner linear slide assembly member (212) is preferably made from a rugged, slippery material such as ultra high molecular weight polyethylene (UHMW), or a filled Nylon, or TEFLON or the like. It is within the scope of this invention that the edges of the T-shaped linear slide assembly member (212). be provided with bearing assemblies, e.g., balls or barrels or the like, although such is really not necessary in this service. Component (212) is fixedly or movably attached to a tray (202).

Rolled edge member (214) cooperates with inner member (212) to allow inner member (212) to slide linearly along the interior of a rolled edge member (214). Again, it is within the scope of this invention to provide bearings in appropriate areas of the linear slide assembly but use of the materials such as UHMW for inner slide member (212) and steel or the like for outer slide assembly member (214) is typically more than sufficient for the instant service.

Rolled edge member (214) is shown with a raised edge region (218) and a hole for fastener assembly (222). The raised edge region (218) may be used as a stop for the movement of interior sliding member (212) as will be shown a bit more below. Alternatively, the head of the bolt (224) may be used as a stop if so desired.

Another optional, but highly desirable, component of the tray assembly (200) is the keeper (215). As mentioned elsewhere, this assembly (200) may be used with a wire rack-type shelf. As will be shown with respect to FIGS. 5A–5C below, the keeper (215) has the function of holding the assembly in place on the shelf by engaging the front lip (217) of the keeper (215) with the cross-piece located on the front of the shelf. Typically, when used with the nut-and-bolt assembly (222), the keeper (215) will be bolted to the linear slide assembly. Fastener assembly (222) is generally not cinched down very tight as will be shown with respect to the later Figures, this fastener assembly (222) has a number of functions when the overall assembly (200) is used with, e.g., a wire rack shelf. In this variation, the washer (226) prevents separation of the rolled edge member (214) from the wire rack shelf (as seen in FIG. 1) and bolt (224) helps to prevent the rolled edge member from moving linearly off the front of the supporting shelf along with the open top tray (202).

At the back of the linear slide assembly is seen a clip (230) which is affixedly or removably attached to the rolled edge member (214) and has the further function of clipping the upper or back end of rolled edge member (214) to the back of supporting shelf. Obviously, other variations of the clipped member (230) which are more or less permanent may be used. A clip over the back end of the shelf or another nut and bolt would be equally suitable.

Figure 2B:
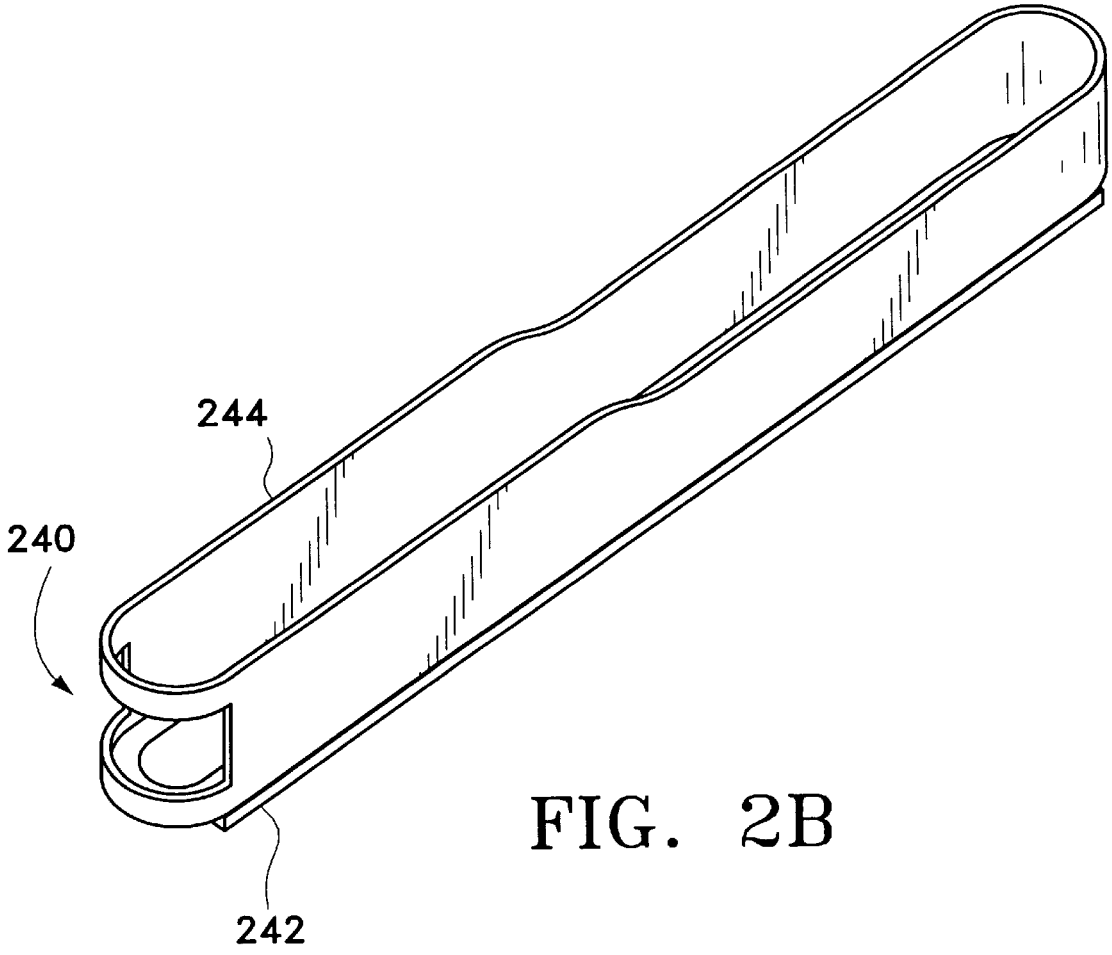
FIG. 2B shows, in perspective, a unitary tray assembly in which a portion of the slide assembly is molded with the tray itself.

FIG. 2B shows a variation of the tray (240) in which the T-rail (242) is integrally molded with the tray (244) itself.

Figure 3:
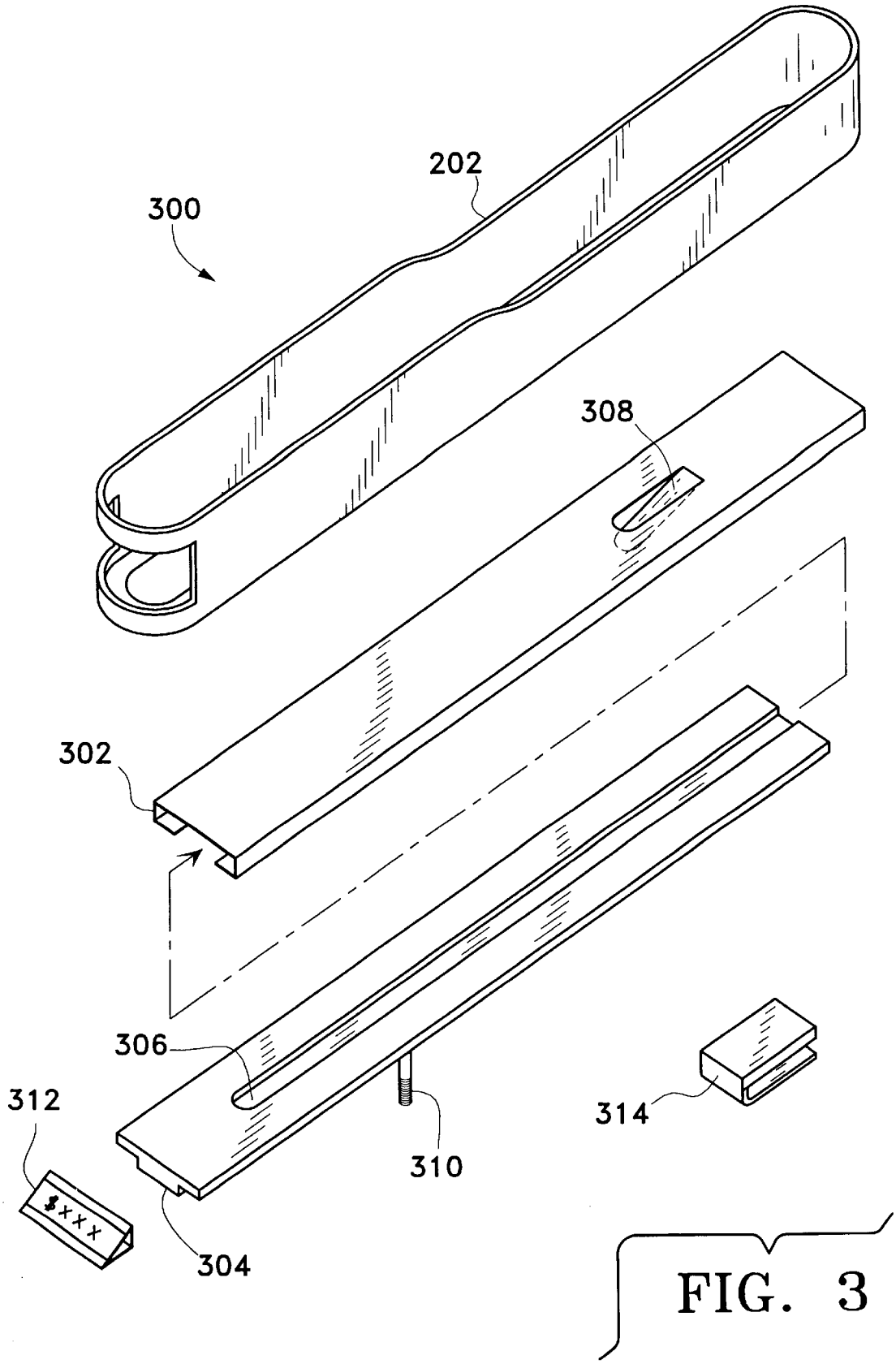
FIG. 3 is an exploded diagram of another variation of the invention.

FIG. 3 shows another alternative of the inventive tray assembly (300). This variation is similar to that shown in FIG. 2. A high-walled elongated open top tray (202) is similarly found in FIG. 3. In this variation, the rolled edge linear slide member (302) is affixedly or detachably affixable to the open top tray (202). The inner or T-shaped slide member (304) is, in a sense, the one which is attached to the supporting shelf. The inner slide member (304) includes a slot (306) which cooperates with the tab (308) cut into rolled edge member (302). Tab (308) and slot (306). cooperate to prevent the inner slide member (304) from exiting the rolled edge linear slide member (302). The materials making up each of these components is the same as those discussed with respect to the FIG. 2A variation. In this variation, the inner slide member has a fixed stub (310) sticking below the inner linear slide member (304). Stub (310) may be a stud having threads on it for acceptance of a nut or a washer or a crimped on device. In any event, the stub (310) is intended to prevent linear movement of the assembly (300) during loading operation and to allow modest rotation of the whole assembly upwardly to allow clearance of the assembly (300) from the inherent stop and to prevent side to side movement of the assembly (300). Also shown in FIG. 3 is a price marker panel (312) which may be fixed below T-shaped inner member (304) and if properly so-affixed, may be used as a handle to raise the assembly (300) for loading.

Finally, in FIG. 3 is a variation of rear clip (314). It is simply a slide-on U-shaped clip which may be used, e.g., to mesh with the rear rail of a wire shelf such as was shown in FIG. 1.

Figure 4:
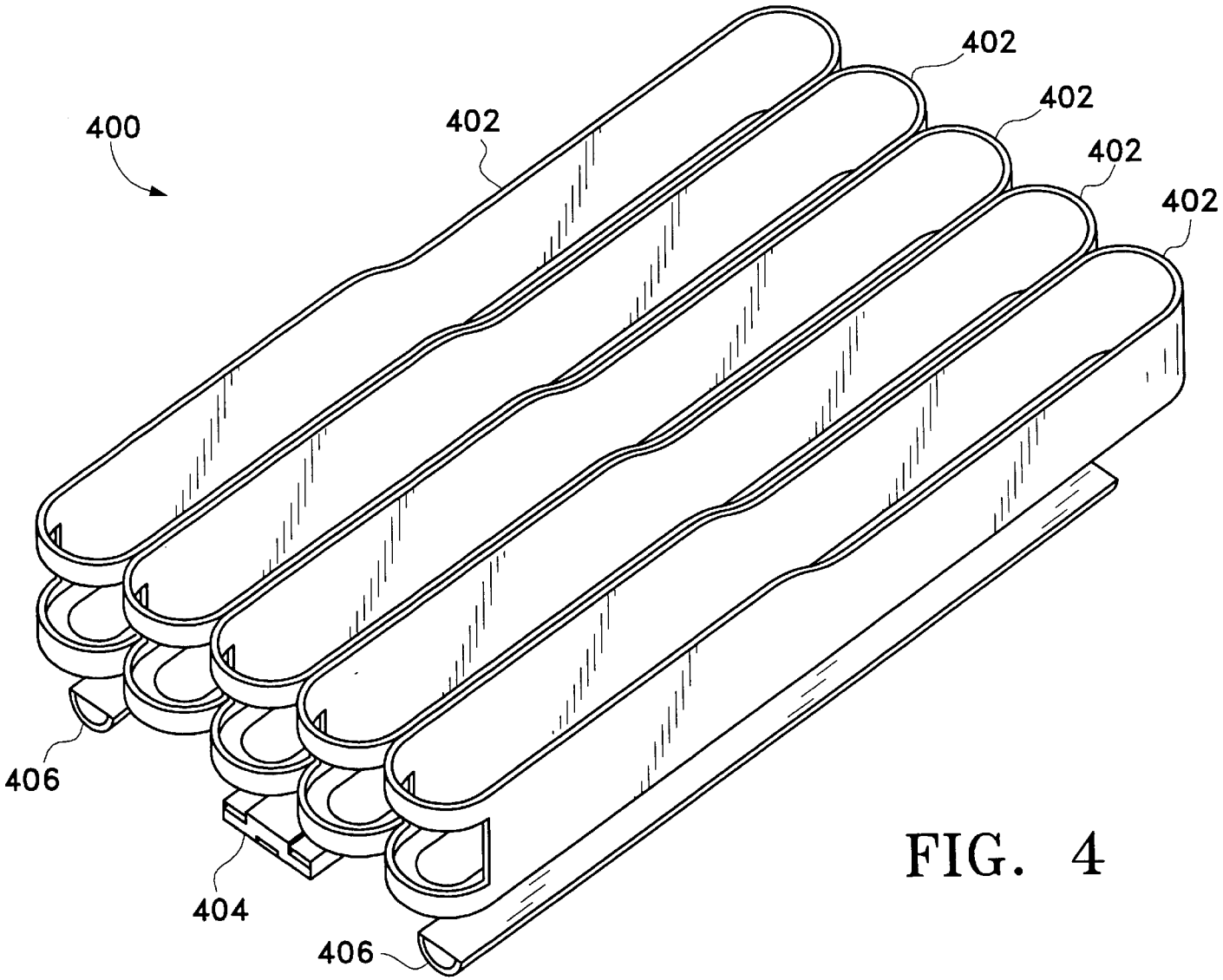
FIG. 4 shows a multi-tray variation of the inventive tray assembly.

FIG. 4 shows a variation (400) of the invention in which a number of open top trays (402) are attached together. These co-affixed trays (402) move together as a unit on a single slide assembly (404). In this instance, the middle tray (402) is attached fixedly or otherwise joined to the co-joined trays (402). In addition, a pair of rub rails (406) are shown as an optional feature to prevent undue stress on the joints between the pairs of adjacent trays (402). The rub rails are, of course, optional. Similar transverse rather than longitudinal rub rails or the like may be applied where the underlying shelf or support utilizes only longitudinal wires.

Figures 5A, 5B, 5C:
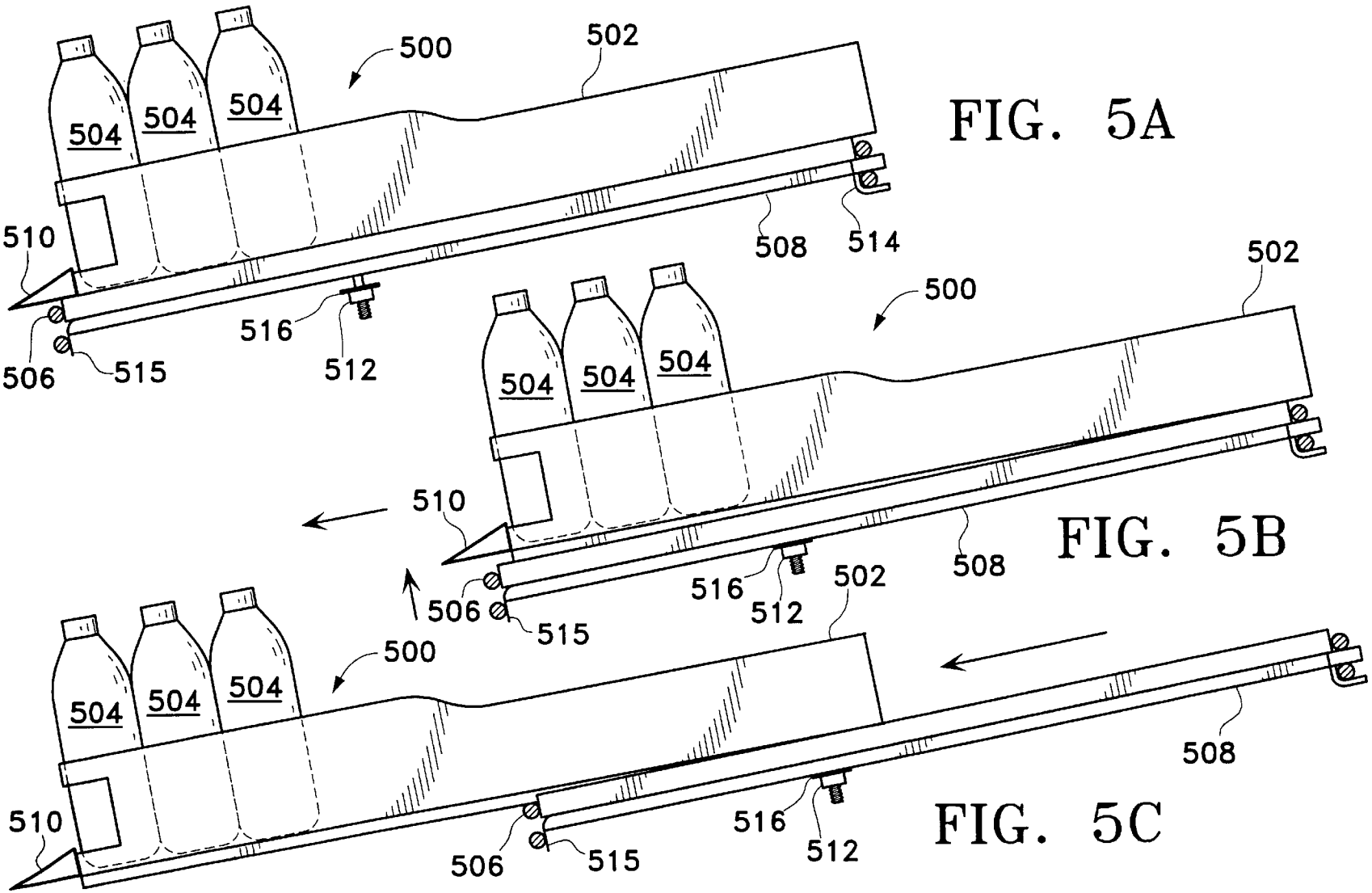
FIGS. 5A–5C show the use of the inventive tray assembly.

FIGS. 5A, 5B, and 5C show the sequence of use for a device made according to this invention. FIG. 5A shows an open topped tray (502) having several drink containers (504) placed therein. The normal tendency of the slide assembly to slide downhill with gravity is stopped by the presence of the front rail (506) of the underlying wire shelf assembly (508). The price marker panel (510) may be seen as well as the front of fastener (512) and the rear fastener (514). It will be noted that front fastener (512) has a fair amount of "looseness" in that washer (516) is a substantial distance from the bottom of shelf (508). Also, to be noted is that the rear fastener (514) is a nut and bolt assembly.

FIG. 5B shows the use of the price sign (510) as a handle to raise the assembly (500) so that the linear slide assembly members collectively clear front rear rail (506). The nut and washer (516) on front fastener (512) are shown pulled up fairly tight against shelf (508). It should be apparent that the assembly (500) is now cleared over the top of the front rail (506). Keeper (515) is shown to prevent to movement of the slide assembly with respect to the shelf (508). The keeper (515) slips between the longitudinal wires of the shelf when the assembly is at rest as shown in FIG. 5A, but rests against the front rails (506) of the shelf when the tray (502) is loaded to keep the lower section of the tray assembly in position.

FIG. 5C shows tray assembly (500) having moved forward over front rail (506) so that additional containers may be placed behind those (504) already in tray (502).

Many alterations and modifications may be made by those of ordinary skill in the art without departing from the spirit and scope of this invention. The illustrated embodiments have been shown only for the purposes of clarity. The example should not be taken as limiting the invention as defined in the following claims, which claims include all equivalents, whether those equivalents are known now or will be known later.

I claim as my invention:

1. A tray assembly adapted to be attached to a wire rack shelf disposed therebeneath, said tray assembly configured for holding containers and delivering the containers to a front of said tray assembly by gravity, said tray assembly comprising:

at least one elongated, open top tray having a surrounding wall at least on a front and two sides which define a container-holding region therebetween, and having a tray bottom, said surrounding wall on said sides directing the containers via gravity to the front of said tray when said tray assembly is tilted so that the front of the tray is at a position lower than the rest of the tray, a first linear slide component cooperatively slidable with respect to a second linear slide component, positioned beneath said tray bottom, and substantially movable with said tray, said second linear slide component cooperatively slidable with respect to said first linear slide component, wherein when said first and second linear slide components are at a first tilt, the first and second linear slide components are prevented from sliding with respect to each other, said first and second linear slide components cooperatively configured to be tilted together to a tilt away from the first tilt so to allow the first and second linear slide components to then become slidable with respect to each other, and a first fastener for maintaining the position of said second linear slide component in a tiltable but otherwise substantially fixed position with respect to said wire rack shelf during the cooperative sliding movement such that the tray extends relative to the wire rack shelf.

2. The tray assembly of claim 1 wherein said first linear slide component is affixed to said at least one elongated, open top tray.

3. The tray assembly of claim 1 wherein said at least one elongated, open top tray comprises a plurality of open top trays.

4. The tray assembly of claim 1 wherein said first linear slide component is a rolled edge cross section slide.

5. The tray assembly of claim 1 wherein said second linear slide component is a rolled edge cross section slide.

6. The tray assembly of claim 1 wherein said first fastener comprises a clip.

7. The tray assembly of claim 1 further comprising a wire rack shelf supporting said at least one elongated, open top tray, wherein said first linear slide component is attached to said tray, and said second linear slide component, and said wire rack shelf being connected to said second linear slide component.

8. A tray assembly adapted to be attached to a wire rack shelf disposed therebeneath, said tray assembly configured for holding containers and delivering the containers to a front of said tray assembly by gravity, said tray assembly comprising:

at least one elongated, open top tray having a surrounding wall at least on a front and two sides which define a container-holding region therebetween, and having a tray bottom, said surrounding wall on said sides directing the containers via gravity to the front of said tray when said tray assembly is tilted so that the front of the tray is at a position lower than the rest of the tray, a first linear slide component cooperatively slidable with respect to a second linear slide component, positioned beneath said tray bottom, and substantially movable with said tray, said second linear slide component cooperatively slidable with respect to said first linear slide component, wherein when said first and second linear slide components are at a first tilt, the first and second linear slide components are prevented from sliding with respect to each other, said first and second linear slide components cooperatively configured to be tilted together to a tilt away from the first tilt so to allow the first and second linear slide components to then become slidable with respect to each other, and a first fastener for maintaining the position of said second linear slide component in a tiltable but otherwise substantially fixed position with respect to said wire rack shelf during the cooperative sliding movement, and wherein said first linear slide component is co-molded with said at least one elongated, open top tray.

9. A tray assembly adapted to be attached to a wire rack shelf disposed therebeneath, said tray assembly configured for holding containers and delivering the containers to a front of said tray assembly by gravity, said tray assembly comprising:

at least one elongated, open top tray having a surrounding wall at least on a front and two sides which define a container-holding region therebetween, and having a tray bottom, said surrounding wall on said sides directing the containers via gravity to the front of said tray when said tray assembly is tilted so that the front of the tray is at a position lower than the rest of the tray, a first linear slide component cooperatively slidable with respect to a second linear slide component, positioned beneath said tray bottom, and substantially movable with said tray, said second linear slide component cooperatively slidable with respect to said first linear slide component, wherein when said first and second linear slide components are at a first tilt, the first and second linear a slide components are prevented from sliding with respect to each other, said first and second linear slide components cooperatively configured to be tilted together to a tilt away from the first tilt so to allow the first and second linear slide components to then become slidable with respect to each other, a first fastener for maintaining the position of said second linear slide component in a tiltable but otherwise substantially fixed position with respect to said wire rack shelf during the cooperative sliding movement, and a second fastener connected to said second linear slide component and situated to allow tilt of the tray to allow said first linear slide component to move out of contact with a first linear slide component stop, and thereby to permit linear movement between said first linear slide component and said at least one tray with respect to said second linear slide component.

10. The tray assembly of claim 9 wherein the first linear slide component stop is adapted to engage said wire rack shelf.

11. The tray assembly of claim 9 wherein said second fastener comprises a nut and bolt.

12. A tray assembly adapted to be attached to a wire rack shelf disposed therebeneath, said tray assembly configured for holding containers and delivering the containers to a front of said tray assembly by gravity, said tray assembly comprising:

at least one elongated, open top tray having a surrounding wall at least on a front and two sides which define a container-holding region therebetween, and having a tray bottom, said surrounding wall on said sides directing the containers via gravity to the front of said tray when said tray assembly is tilted so that the front of the tray is at a position lower than the rest of the tray, a first linear slide component cooperatively slidable with respect to a second linear slide component, positioned beneath said tray bottom, and substantially movable with said tray, said second linear slide component cooperatively slidable with respect to said first linear slide component, wherein when said first and second linear slide components are at a first tilt, the first and second linear slide components are prevented from sliding with respect to each other, said first second linear slide components cooperatively configured to be tilted together to a tilt away from the tilt so to allow the first and second linear slide components to then become slidable with respect to each other, and a first fastener for maintaining the position of said second linear slide component in a tiltable but otherwise substantially fixed position with respect to said wire rack shelf during the cooperative sliding movement wherein said first fastener comprises a nut and bolt.

* * * * *